US008063730B2

(12) United States Patent
Chen et al.

(10) Patent No.: US 8,063,730 B2
(45) Date of Patent: Nov. 22, 2011

(54) THERMISTOR AND ELECTRICAL DEVICE EMPLOYED WITH SAME

(75) Inventors: Lu-Zhuo Chen, Beijing (CN); Chang-Hong Liu, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 393 days.

(21) Appl. No.: 12/381,582

(22) Filed: Mar. 12, 2009

(65) Prior Publication Data

US 2010/0079234 A1 Apr. 1, 2010

(30) Foreign Application Priority Data

Sep. 30, 2008 (CN) ..... 2008 1 0216588

(51) Int. Cl.
*H01C 7/10* (2006.01)

(52) U.S. Cl. ..... 338/22 R; 252/510; 219/538; 428/323; 338/223

(58) Field of Classification Search ..... 338/22 R, 338/223–224, 334; 252/510–511; 219/538, 219/552, 553; 428/323
See application file for complete search history.

(56) References Cited

U.S. PATENT DOCUMENTS

| | | | | |
|---|---|---|---|---|
| 4,801,784 | A * | 1/1989 | Jensen et al. | 219/548 |
| 5,928,547 | A * | 7/1999 | Shea et al. | 219/505 |
| 7,341,679 | B2 * | 3/2008 | Handa | 252/500 |
| 7,642,489 | B2 | 1/2010 | Liu et al. | |
| 2005/0170169 | A1 * | 8/2005 | Watanabe et al. | 428/323 |
| 2009/0121196 | A1 * | 5/2009 | El Bounia | 252/511 |

FOREIGN PATENT DOCUMENTS

CN 101090586 12/2007

* cited by examiner

*Primary Examiner* — Kyung Lee
(74) *Attorney, Agent, or Firm* — Altis Law Group, Inc.

(57) ABSTRACT

An electrical device includes a thermistor and at least two electrodes electrically connected to the thermistor and to which a source of electrical power is applied to cause current to flow through the thermistor. The thermistor may be a composite and includes a polymer material; and a plurality of conductive carbon nanotubes distributed in the polymer material. The electrical device employed with the thermistor performs not only PTC property, but also NTC property. Moreover, the method for fabricating the electrical device is also simple and easy to carry out because of the simple process.

18 Claims, 6 Drawing Sheets

THERMISTOR AND ELECTRICAL DEVICE EMPLOYED WITH SAME

BACKGROUND

1. Technical Field

The present disclosure relates to electrical devices and, in particular, to an electrical device employed with a thermistor that is self-regulating with respect to temperature.

2. Discussion of the Related Art

A positive temperature coefficient (PTC) thermistor includes a pair of electrodes positioned facing each other and a thermistor element positioned between the electrodes. The thermistor element has a PTC of resistance, meaning that within a specific temperature range, its resistance rises sharply as the temperature rises. Taking advantage of these features, the positive temperature coefficient thermistor (hereunder "PTC thermistor") may be used for example as self-regulating heat generators, temperature sensors, current limiting elements, over-current protection elements and the like.

A negative temperature coefficient (NTC) thermistor has the reverse properties with respect to the PTC thermistor, meaning that within a specific temperature range, and its resistance decreases sharply as the temperature rises. The NTC thermistor may be used for specific tasks, such as monitoring the temperature in mobile telephone, controlling the temperature, temperature compensation and the like.

However, some electronic devices, such as application circuits, need a thermistor which functions not only as PTC resistance, but also as NTC resistance. Referring to FIG. 6, a typical thermistor having PTC or NTC properties is disclosed in U.S. Pat. No. 4,801,784, in which a PTC composition 1 is provided on opposing surfaces with electrodes 2 and two NTC compositions 3. The NTC compositions 3 and the electrodes 2 extend across the entire top and bottom surfaces of the PTC composition 1. In this thermistor, when the thermistor is cold, the resistance of the PTC composition 1 is less than that of NTC compositions 3, and current flows from the top left electrode to the bottom right electrode. When the thermistor is hot, the resistance of the PTC composition 1 has increased and that of NTC compositions 3 has decreased. However, the thermistor described above is fabricated by integrating two compositions, i.e. the PTC composition 1 and the NTC composition 3 to allow the thermistor to perform as both NTC and PTC, and the fabrication is very complex.

What is needed, therefore, is a thermistor and an electrical device employed with the same having PTC and NTC properties, which can overcome the above-described shortcoming.

BRIEF DESCRIPTION OF THE DRAWINGS

The present thermistor having PTC and NTC property and electrical device employed with the thermistor are described in detail hereinafter, by way of example and description of an exemplary embodiment thereof and with references to the accompanying drawings, in which.

DETAILED DESCRIPTION

A detailed explanation of a thermistor and an electrical device employed with the thermistor according to an exemplary embodiment will now be made with references to the drawings attached hereto.

Figure 1:
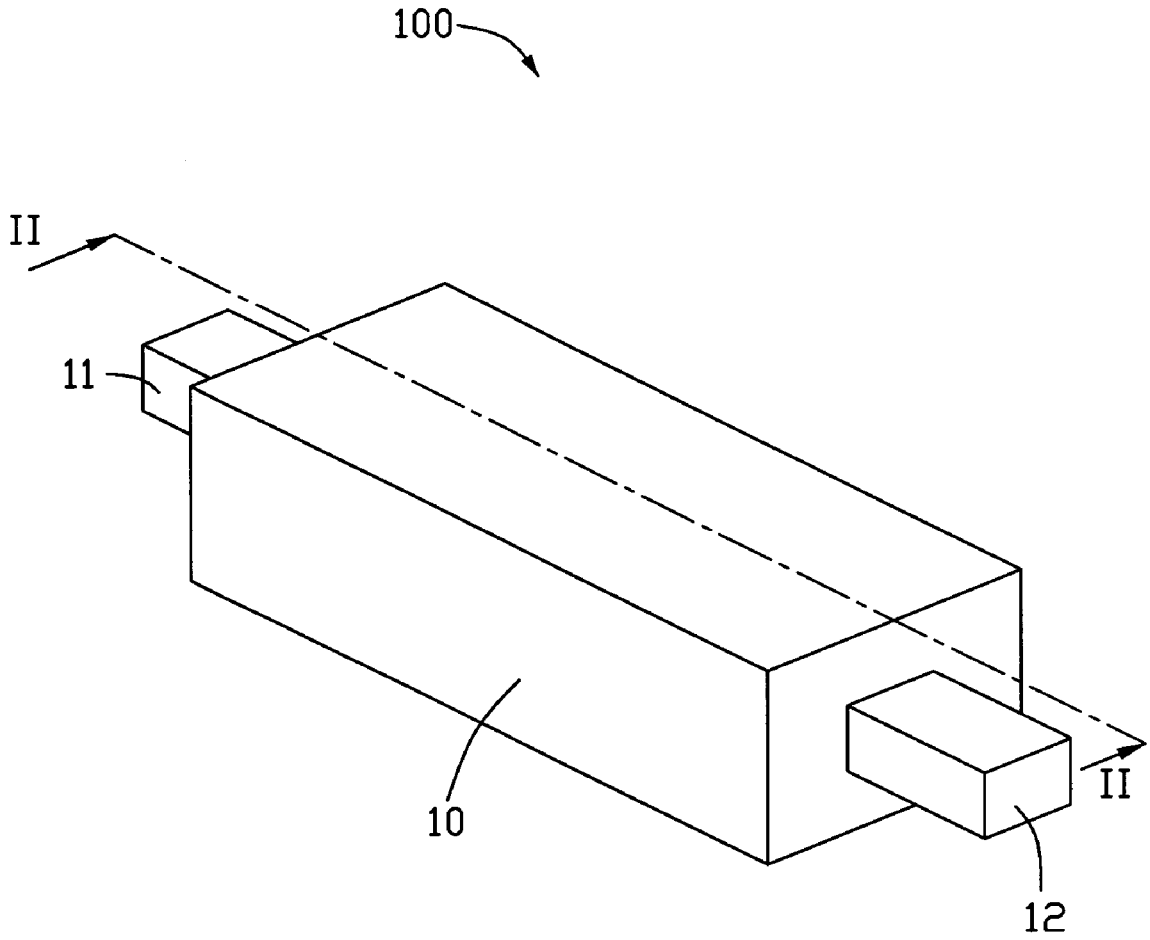
FIG. 1 is an isotropic view of an electrical device employed with a thermistor according to an exemplary embodiment.
Figure 2:
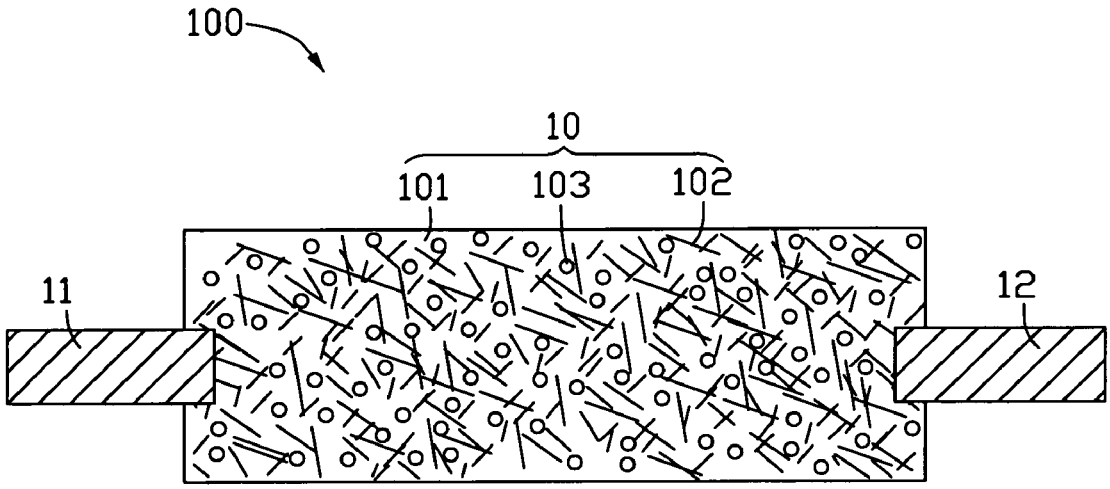
FIG. 2 is a schematic, cross-sectional view of the electrical device of FIG. 1, along line II-II.

Referring to FIGS. 1-2, an electrical device 100 according to an exemplary embodiment is shown. The electrical device 100 includes a thermistor 10, a first electrode 11 and a second electrode 12 electrically connected to one end of the thermistor 10. The first and second electrodes 11, 12 are configured for causing current to flow through the thermistor 10 when a source of electrical power (not shown) is applied to the first and second electrodes 11, 12.

The thermistor 10 may consist of a composite of materials that include polymer material 101 and a number of conductive carbon nanotubes 102 distributed in the polymer material 101. The polymer material 101 may be made of flexible polymer material or hard polymer material. The flexible polymer material may be selected from a group consisting of silicon rubber, polyurethane, epoxy resin, polymethylmethacrylate, and the like. The hard polymer material may be selected from a group consisting of ceramics and hard plastics. In the present embodiment, the polymer material 101 is silicon rubber. The silicon rubber includes a component A and a component B mixed with each other. The component A in the silicon rubber has a weight percent of about 90% to about 94%. The component A may be hydroxy-terminated single-chain polysiloxane (PDMS) and the component B may be tetraethoxysilane (TEOS) functioning as a curing agent. In the present embodiment, the TEOS has a weight percent of about 6% in the silicon rubber. As temperature of the thermistor 10 rises, the polymer material 101 may expand. The thermistor 10 may have an expansion ratio of about 1% to about 8% in the present embodiment.

The carbon nanotubes 102 are uniformly distributed in the polymer material 101 as desired by a means such as application of ultrasonic vibrations, and two or more of these carbon nanotubes 102 are electrically connected to each other. The carbon nanotubes 102 in the thermistor 10 may have a weight percent of about 2% to about 10%. In the present embodiment, the carbon nanotubes 102 comprise about 5% by weight of the thermistor 10, which is enough to ensure the conductivity as the high aspect ratio characteristic thereof. The carbon nanotubes 102 each may have a length of about 1 μm to about 20 μm and be one or more of conductive single wall carbon nanotube (SWCNT), double wall carbon nanotube (DWCNT), and/or multi wall carbon nanotube (MWCNT). The conductive SWCNT may have a diameter of about 0.5 nm to about 50 nm. The DWCNT may have a diameter of about 1.0 nm to about 50 nm. And the MWCNT may have a diameter of about 1.5 nm to 50 nm. In the present embodiment, the carbon nanotubes 102 are each MWCNT having a length of about 1 μm to about 10 μm.

The first and second electrodes 11, 12 are electrically connected to the thermistor 10. The first and second electrodes 11, 12 may be fixed in place by inserting them into the thermistor 10 during solidification of the thermistor 10 or they may be mounted on the surface of the thermistor 10 with the use of conductive adhesive. In the present embodiment, the first and second electrodes 11, 12 are inserted into the thermistor 10 during solidification. The first and second electrodes 11, 12 are generally sheet or wire shaped and have thicknesses of about 10 nm to about 5 cm, and are made of conductive materials or alloy, such as copper, aluminum, palladium, platinum, gold, or their alloy. In the present embodiment, the first and second electrodes 11, 12 are wire-shaped gold and have a thickness of about 200 nm.

In use, when the thermistor 10 receives some heat, thereby resulting in a increasing temperature thereof, the resistance value of the thermistor 10 may decrease in one temperature range, and then rise in another temperature range as the temperature of the thermistor 10 rises, and vice versa. It can be understood that the thermistor 10 may have a critical temperature, in which the resistance value of the thermistor 10 is at its lowest. The characteristic of the thermistor 10 described above relates to the structure of the carbon nanotubes 102 thereof. The work principle of the thermistor 100 may be explained as follows.

Figure 3:
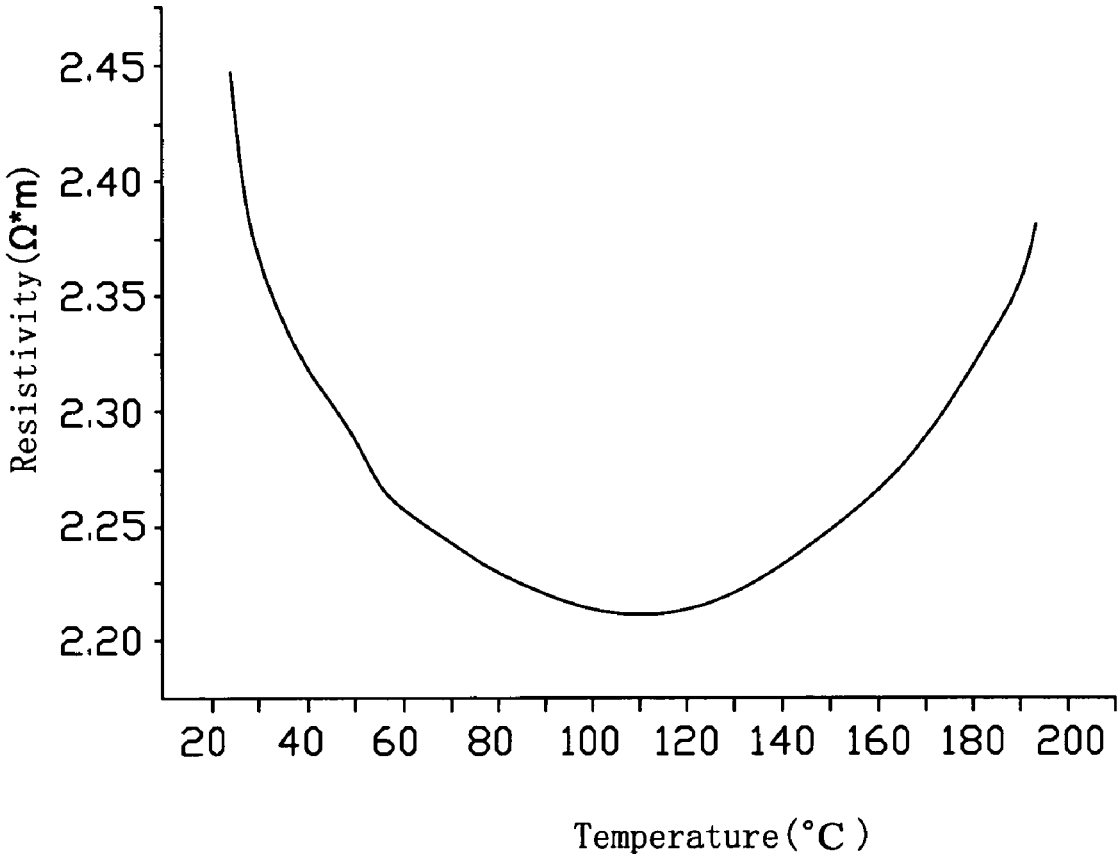
FIG. 3 is a temperature-resistance graph of the electrical device of FIG. 1.

Referring to FIG. 3, a temperature-resistance graph of the thermistor 10 when current passes through the electrical device 100 is shown. In the present embodiment, the critical temperature of the thermistor 10 is about 110° C. When in a first temperature of the thermistor 10 is lower than the critical temperature, two or more of the carbon nanotubes 102 of the thermistor 10 are electrically connected to each other. As is well known, the structure of a SWCNT can be conceptualized by wrapping a one-atom-thick layer of graphite called graphene into a seamless cylinder, and the MWCNT consists of multiple layers of graphite sheet rolled in on them to form a tube shape. And the diameter of the carbon nanotube is close to the axis distance between two adjacent graphite layers. Therefore, free electrons can freely move along the axis direction of the carbon nanotubes but difficultly moving cross to the axis direction. As the temperature increases, the free electrons receive more energy, thereby accelerating. Therefore, the conductivity of the thermistor 10 increases and the resistance value thereof decreases until the critical temperature is reached, which provides a NTC property. As the first temperature rises to the critical temperature, the resistivity may reach a least value. As the temperature of the thermistor 10 further rises to a second temperature higher than the critical temperature, the polymer materials 101 may further expand, thereby destroying the connection between the carbon nanotubes 102. As such, two or more of the connected carbon nanotubes 102 in the first temperature are destroyed and insulated from each other, thereby resulting in increase of the resistance value of the thermistor 10. As the second temperature further rises, the larger the volume of the polymer materials 101 becomes, the more amount of the insulated carbon nanotubes 102 that are electrically connected to each other in the first temperature become. Therefore, the conductivity of the thermistor 10 decreases and the resistance value thereof increases, which provides an PTC property.

The thermistor 10 may further include a number of carbon black particles 103 for further ensuring the conductivity thereof. The weight percent of the carbon nanotubes 102 and the carbon black particles 103 are equal to or less than about 15%, and the weight ratio between the carbon nanotubes 102 and the carbon black particles 103 ranges from about 1:1 to about 1:5. The weight percent of the carbon black particles 103 ranges from about 5% to about 13% and the carbon black particles 103 have a diameter of about 1 nm to about 200 nm. In the present embodiment, the carbon black particles 103 have a weight percent of about 6% and a diameter of about 1 nm to about 100 nm.

Figure 4:
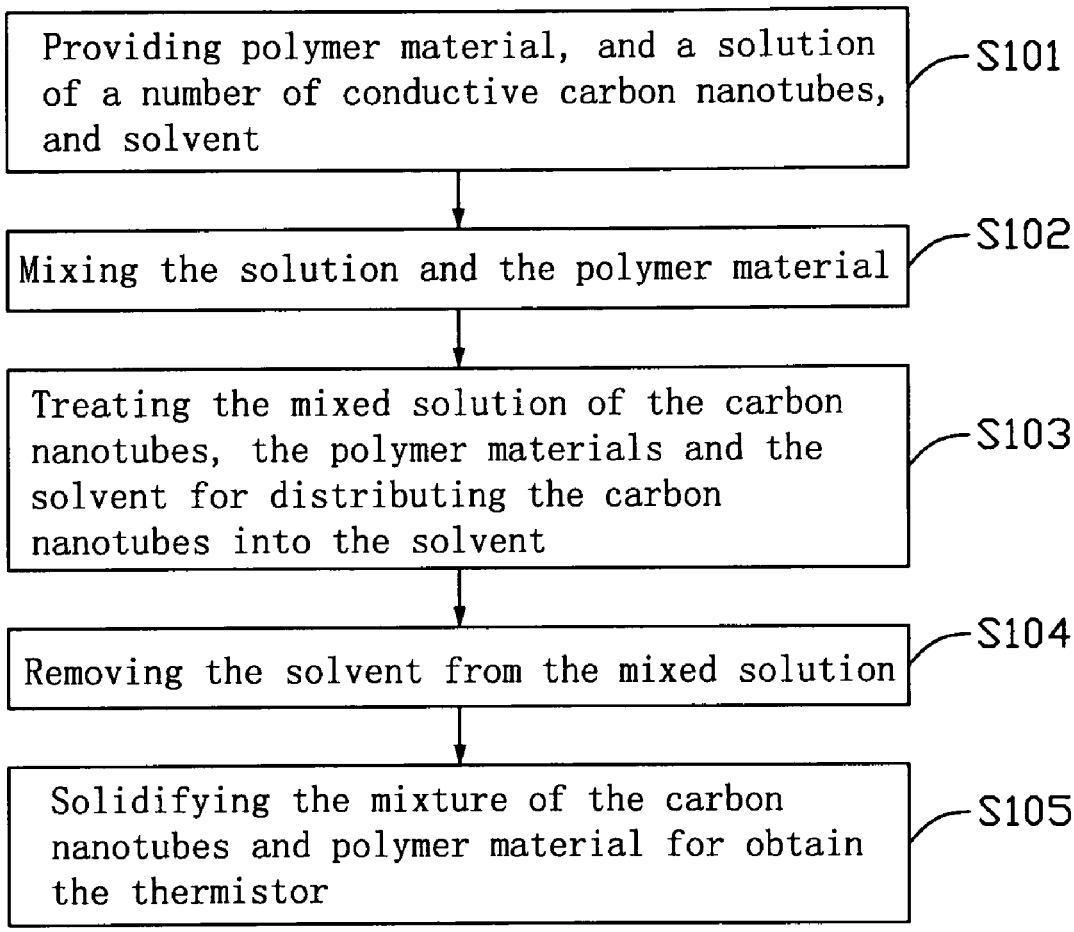
FIG. 4 is a flowchart of a method for manufacturing the thermistor of FIG. 1.

Referring to FIG. 4, a method for manufacturing the thermistor 10 according to the exemplary embodiment is shown. The method includes:

step S101: providing polymer material 101, and a solution of a number of conductive carbon nanotubes 102, and solvent;

step S102: mixing the solution and the polymer material 101;

step S103: distributing the carbon nanotubes 102 into the solvent;

step S104: removing the solvent from the mixed solution; and step 105: solidifying the composite of the carbon nanotubes and polymer material.

In step S101, the solvent is employed for solving the polymer material 101 so as to assist in uniformly distribution of the carbon nanotubes 102 into polymer material 101.

Figure 5:
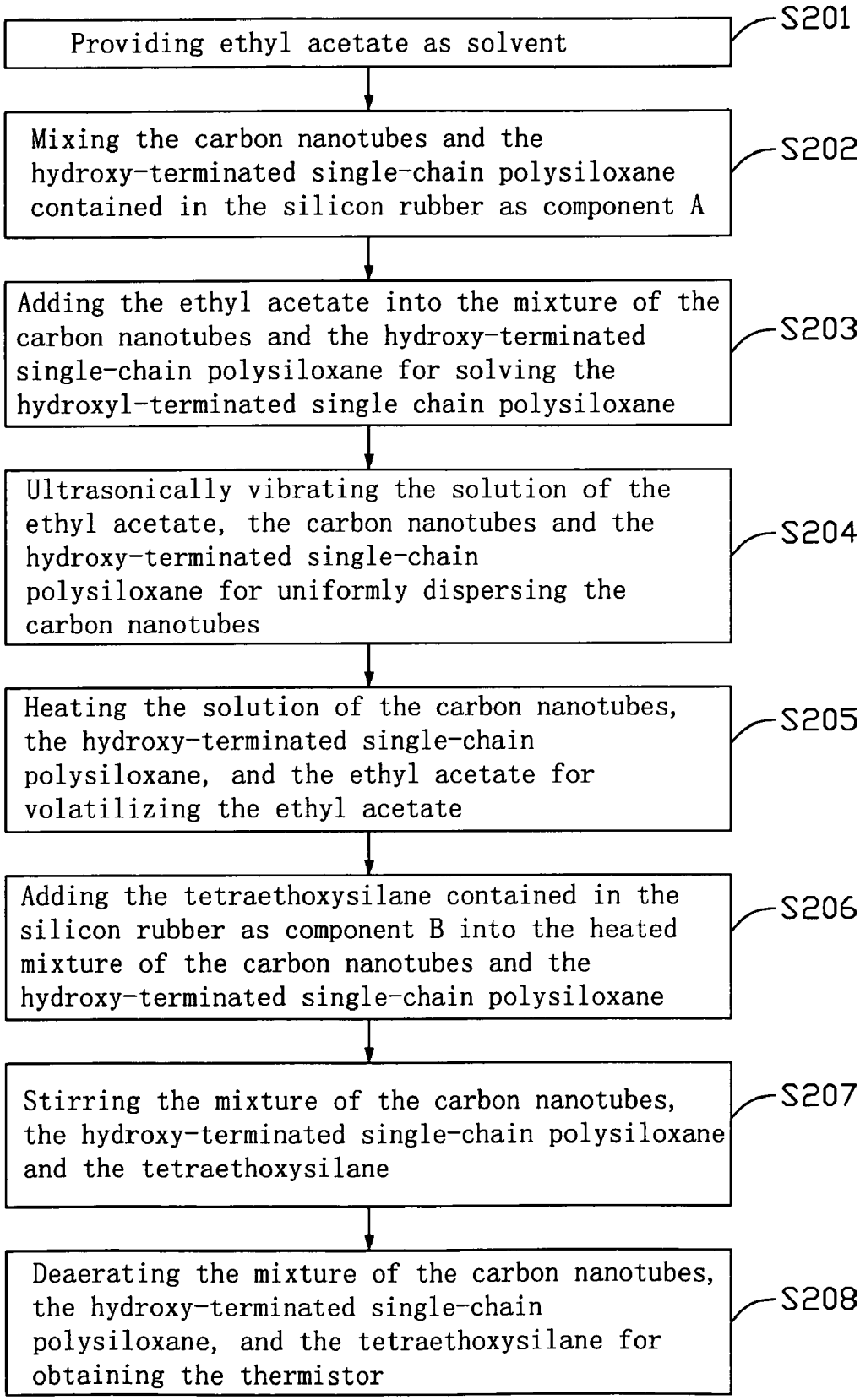
FIG. 5 is a flowchart of a method of manufacturing the thermistor, which being made of a number of carbon nanotubes and silicon rubber.
Figure 6:
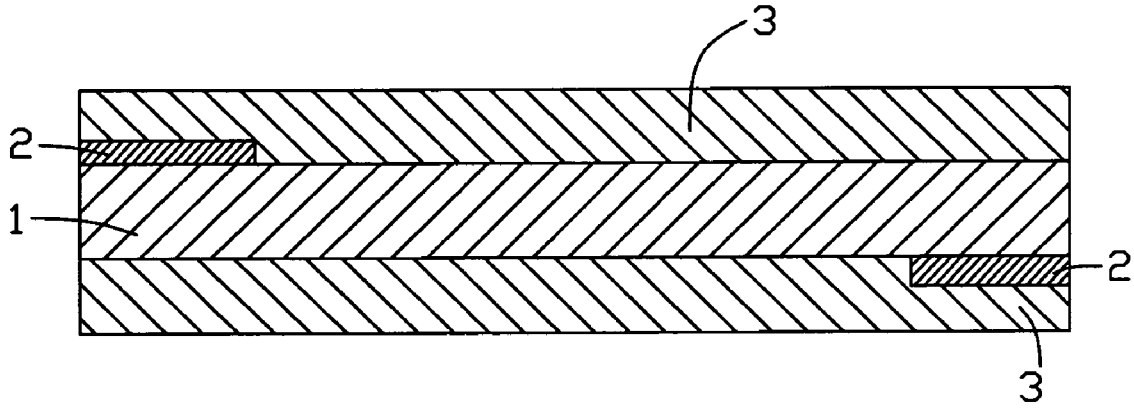
FIG. 6 is a schematic, cross-sectional view of a typical thermistor.

In the present embodiment, the polymer material 101 comprises of silicon rubber. The silicon rubber is presented only as example to explain the method of fabricating the thermistor 10, and any polymer suitable for the desired environment can be used. Referring to FIG. 5, an example for method for fabricating the thermistor 10, which includes the carbon nanotubes 102 and the silicon rubber, is shown. The method includes:

step S201: providing ethyl acetate as solvent;

step S202: mixing the carbon nanotubes 102 and the hydroxy-terminated single-chain polysiloxane contained in the silicon rubber as component A;

step S203: adding the ethyl acetate into the composite of the carbon nanotubes 102 and the hydroxy-terminated single-chain polysiloxane for solving the hydroxyl-terminated single chain polysiloxane;

step S204: ultrasonically vibrating the solution of the ethyl acetate, the carbon nanotubes 102 and the hydroxy-terminated single-chain polysiloxane for uniformly dispersing the carbon nanotubes 102;

step S205: heating the solution of the carbon nanotubes 102, the tetraethoxysilane, and the ethyl acetate for volatilizing the ethyl acetate;

step S206: adding the tetraethoxysilane contained in the silicon rubber as component B into the heated composite of the carbon nanotubes 102 and the hydroxy-terminated single-chain polysiloxane, step S207: stirring the composite of the carbon nanotubes 102, the hydroxy-terminated single-chain polysiloxane and the tetraethoxysilane; and step S208: deaerating the composite of the carbon nanotubes, the hydroxy-terminated single-chain polysiloxane, and the tetraethoxysilane for obtaining the thermistor 10.

The first and second electrodes 11, 12 can be disposed on the obtained thermistor 10. The electrical device 100 can be applied to various appliances, such as household appliances, computer, telecommunication, speaker, industrial controlling system, temperature sensor, temperature monitoring, and so on. The electrical device 100 employed with the thermistor 10 has not only PTC properties, but also NTC properties. Moreover, the method for fabricating the electrical device 100 is also simple and easy to carry out because of the simple process.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

It is also to be understood that above description and the claims drawn to a method may include some indication in reference to certain steps. However, the indication used is only to be viewed for identification purposes and not as a suggestion as to an order for the steps.

What is claimed is:

1. A thermistor, comprising:

a composite comprising:

a polymer material, wherein the polymer material comprises a silicon rubber comprising a hydroxy-terminated single-chain polysiloxane and a tetraethoxysilane, and the tetraethoxysilane in the silicon rubber has a weight percent in a ranges from about 6% to about 10%; and a plurality of conductive carbon nanotubes distributed in the polymer material.

2. The thermistor as claimed in claim 1, wherein the polymer material comprises a hard polymer material.

3. The thermistor as claimed in claim 2, wherein the hard polymer material comprises a material selected from the group consisting of ceramic, hard plastic, and any combinations thereof

4. The thermistor as claimed in claim 1, wherein the carbon nanotubes comprise single wall carbon nanotubes, double wall carbon nanotubes, multi wall carbon nanotubes or a combination thereof

5. The thermistor as claimed in claim 1, wherein the composite further comprises a plurality of carbon black particles distributed in the polymer material.

6. The thermistor as claimed in claim 5, wherein a weight percent of the carbon nanotubes and the carbon black particles in the composite is equal to or less than about 15%, and a weight ratio of the carbon nanotubes to the carbon black particles ranges from about 1:1 to about 1:5.

7. The thermistor as claimed in claim 5, wherein a weight percent of the carbon black particles in the composite ranges from about 5% to about 13%, and the carbon black particles have an average diameter of about 1 nm to about 200 nm.

8. The thermistor as claimed in claim 1, wherein an expansion ratio of the composite ranges from about 1% to about 8%.

9. An electrical device, comprising:

a thermistor comprising:

a composite comprising:

a polymer material; and a plurality of conductive carbon nanotubes and carbon black particles distributed in the polymer material, wherein a weight percent of the carbon black particles in the composite ranges from about 1% to about 15%, and the carbon black particles have an average diameter of about 1 nm to about 200 nm; and at least two electrodes electrically connected to the thermistor.

10. A method for fabricating a thermistor, comprising:

providing a polymer material, a solution containing a plurality of carbon nanotubes, and a solvent, wherein the polymer material is a silicon rubber made of a hydroxy-terminated single-chain polysiloxane and a tetraethoxysilane, and the tetraethoxysilane has a weight percent ranges from about 6% to about 10%;

mixing the polymer material into the solution of the carbon nanotubes and the solvent to form a mixed solution;

dispersing the carbon nanotubes into the mixed solution; and removing the solvent from the mixed solution.

11. The method as claimed in claim 10, wherein the solvent comprises ethyl acetate.

12. The method as claimed in claim 11, wherein the method of manufacturing the thermistor including the carbon nanotubes and the silicon rubber, comprising:

providing the ethyl acetate;

mixing the carbon nanotubes and the hydroxy-terminated single-chain polysiloxane;

adding the ethyl acetate into the composite of the carbon nanotubes and the hydroxy-terminated single-chain polysiloxane for solving the hydroxyl-terminated single chain polysiloxane;

ultrasonically vibrating the solution of the ethyl acetate, the carbon nanotubes and the hydroxy-terminated single-chain polysiloxane for uniformly dispersing the carbon nanotubes;

heating the solution of the carbon nanotubes, the hydroxy-terminated single-chain polysiloxane, and the ethyl acetate for volatilizing the ethyl acetate;

adding the tetraethoxysilane into the heated composite of the carbon nanotubes and the hydroxy-terminated single-chain polysiloxane and stirring the composite of the carbon nanotubes, the hydroxy-terminated single-chain polysiloxane and the tetraethoxysilane; and deaerating the composite of the carbon nanotubes, the hydroxy-terminated single-chain polysiloxane and the tetraethoxysilane.

13. The method as claimed in claim 12, wherein the deaerating treatment is carried out in a vacuum chamber.

14. The electrical device as claimed in claim 9, wherein the polymer material comprises a flexible polymer.

15. The electrical device as claimed in claim 14, wherein the flexible polymer material comprises a material selected from the group consisting of silicon rubber, polyurethane, epoxy resin, polymethylmethacrylate, and any combinations thereof

16. The electrical device as claimed in claim 15, wherein the silicon rubber comprises hydroxy-terminated single-chain polysiloxane and tetraethoxysilane, and tetraethoxysilane in the silicon rubber has a weight percent in a ranges from about 6% to about 10%.

17. The electrical device as claimed in claim 9, wherein the polymer material comprises a hard polymer material.

18. The electrical device as claimed in claim 17, wherein the hard polymer material comprises a material selected from the group consisting of ceramic, hard plastic, and any combinations thereof.

* * * * *